US009840813B2

(12) United States Patent
Browning et al.

(10) Patent No.: US 9,840,813 B2
(45) **Date of Patent: *Dec. 12, 2017**

(54) PAVING STONES

(71) Applicant: Oldcastle Architectural, Inc., Atlanta, GA (US)

(72) Inventors: Leonard Browning, Aurora, IL (US); Robert J. Lundell, Stillwater, MN (US)

(73) Assignee: Oldcastle Architectural, Inc., Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/093,474

(22) Filed: Apr. 7, 2016

(65) Prior Publication Data

US 2016/0222595 A1 Aug. 4, 2016

Related U.S. Application Data

(63) Continuation of application No. 14/056,220, filed on Oct. 17, 2013, now Pat. No. 9,315,950.

(60) Provisional application No. 61/716,033, filed on Oct. 19, 2012.

(51) Int. Cl.
*E01C 5/06* (2006.01)

(52) U.S. Cl.
CPC ..... *E01C 5/06* (2013.01); *E01C 5/065* (2013.01); *E01C 2201/02* (2013.01); *E01C 2201/12* (2013.01)

(58) Field of Classification Search
CPC ... E01C 5/00; E01C 5/06; E01C 5/005; E01C 2201/02; E01C 2201/06; E01C 2201/12
See application file for complete search history.

(56) References Cited

U.S. PATENT DOCUMENTS

| | | | |
|---|---|---|---|
| 653,515 | A | 7/1900 | Kennedy |
| 815,547 | A | 3/1906 | Messmore |
| 1,474,779 | A | 11/1923 | Zur Kammer |
| 1,479,647 | A | 1/1924 | Carroll |
| 1,600,787 | A | 9/1926 | Ardit |
| 1,953,657 | A | 4/1934 | Pierce |
| 2,050,299 | A | 8/1936 | Evers |
| D102,144 | S | 12/1936 | Parker |
| 2,605,681 | A | 8/1952 | Thrief |
| 2,606,428 | A | 8/1952 | Oldfather |

(Continued)

FOREIGN PATENT DOCUMENTS

| | | |
|---|---|---|
| BE | 570711 | 11/1961 |
| CA | 1150553 | 7/1983 |

(Continued)

OTHER PUBLICATIONS

Lawrence, Backyard Brickwork, 1989, p. 76, Garden Way Publishing, Pownal, VT, U.S.A.

(Continued)

*Primary Examiner* — Abigail A Risic
(74) *Attorney, Agent, or Firm* — Merchant & Gould P.C.

(57) ABSTRACT

Generally L-shaped, square, rectangular, triangular, hexagonal, parallelogram and other-shaped paving stones with inter-fitting vertical spacers forming serpentine side contact surfaces that provide enhanced stone-to-stone interlocking in both water-permeable and water-impermeable paving installations.

18 Claims, 10 Drawing Sheets

(56) References Cited

U.S. PATENT DOCUMENTS 2,662,343 A 12/1953 Rice
2,893,098 A 7/1959 Tilley
2,991,213 A 7/1961 Williams
3,171,335 A 3/1965 Pincon et al.
D204,803 S 5/1966 Leeth
3,267,823 A 8/1966 MacRae
3,386,001 A 5/1968 Slosberg et al.
3,600,773 A 8/1971 Davis et al.
D230,478 S 2/1974 Littman et al.
D231,926 S 6/1974 Appleton
3,870,423 A 3/1975 Peitz, Jr.
3,903,702 A 9/1975 Appleton
3,947,192 A 3/1976 Rosenberger
4,026,083 A 5/1977 Hoyt et al.
4,078,760 A 3/1978 Mullins
4,105,354 A 8/1978 Bowman
4,125,341 A 11/1978 Reinschutz
4,131,406 A 12/1978 Fresquez
4,135,840 A 1/1979 Puccini et al.
4,217,740 A 8/1980 Assanti
4,231,677 A 11/1980 Roming
D257,824 S 1/1981 Puccini et al.
D257,825 S 1/1981 Puccini et al.
4,287,141 A 9/1981 Russell
4,313,689 A 2/1982 Reinschutz
4,349,293 A 9/1982 Rosenberger
4,354,773 A 10/1982 Noack
4,407,480 A 10/1983 Trimmer et al.
D272,037 S 1/1984 Puccini
4,452,419 A 6/1984 Saleeba
4,510,725 A 4/1985 Wilson
4,544,305 A 10/1985 Hair
D281,505 S 11/1985 Larsen et al.
4,572,699 A * 2/1986 Rinninger ..... E01C 5/06 404/42
4,609,303 A 9/1986 Shumaker
4,627,764 A 12/1986 Scheiwiller
D287,884 S 1/1987 Scheiwiller
4,761,095 A 8/1988 Bartlechner
4,773,790 A 9/1988 Hagenah
4,776,723 A 10/1988 Brimo
4,792,257 A 12/1988 Rinninger
4,828,426 A 5/1989 Hendricks et al.
4,834,575 A 5/1989 Barth et al.
4,838,728 A 6/1989 McKeever
4,919,565 A 4/1990 Göpfert
4,921,372 A 5/1990 Hybertson
D314,240 S 1/1991 Scheiwiller
4,997,308 A 3/1991 Welling, Jr.
5,051,023 A 9/1991 Yoshida et al.
5,108,219 A 4/1992 Hair
5,133,620 A 7/1992 Scheiwiller
5,201,843 A 4/1993 Hair
5,211,895 A 5/1993 Jacklich, Sr.
5,230,584 A 7/1993 Grossman
5,244,303 A 9/1993 Hair
D342,528 S 12/1993 Hupp
5,267,810 A 12/1993 Johnson
D343,237 S 1/1994 Johnson, II
D343,238 S 1/1994 Hair
5,277,514 A 1/1994 Glickman
5,281,047 A 1/1994 Skaug
5,286,139 A 2/1994 Hair
D349,967 S 8/1994 Krueger et al.
5,342,142 A 8/1994 Barth et al.
5,348,417 A 9/1994 Scheiwiller
5,449,245 A 9/1995 Glickman
5,486,066 A 1/1996 Hagenah
5,487,526 A 1/1996 Hupp
5,496,129 A 3/1996 Dube
5,520,388 A 5/1996 Osborn
5,524,396 A 6/1996 Lalvani
5,560,173 A * 10/1996 Scheiwiller ..... B44C 3/123 404/41
5,568,391 A 10/1996 Mckee
5,588,775 A 12/1996 Hagenah
5,597,591 A 1/1997 Hagenah
5,619,830 A 4/1997 Osborn
5,625,990 A 5/1997 Hazlett
5,645,369 A 7/1997 Geiger
5,678,370 A * 10/1997 Douglass ..... E01C 5/00 404/37
5,713,155 A 2/1998 Prestele
5,797,698 A 8/1998 Barth et al.
D397,802 S 9/1998 Terry
D399,978 S 10/1998 Barth et al.
D404,147 S 1/1999 Woolford
5,884,445 A 3/1999 Woolford
5,887,846 A 3/1999 Hupp
5,902,069 A 5/1999 Barth et al.
5,921,705 A 7/1999 Hodson et al.
5,941,657 A 8/1999 Banze
5,945,181 A 8/1999 Fisher
D424,212 S 5/2000 Abbrancati
D426,897 S 6/2000 Abbracati
6,073,411 A 6/2000 Ciccarello
D429,343 S 8/2000 Milot
D429,530 S 8/2000 Fleishman
D431,870 S 10/2000 Ziegler, Jr.
D431,871 S 10/2000 Abbrancati
6,168,347 B1 1/2001 Milot et al.
D439,677 S 3/2001 Mattox
6,263,633 B1 7/2001 Hagenah
D452,015 S 12/2001 Aurelius
RE37,694 E 5/2002 Riccobene
D463,866 S 10/2002 Jang
6,471,440 B1 10/2002 Scheiwiller
D471,990 S 3/2003 Riccobene
6,536,988 B2 3/2003 Geiger
D480,819 S 10/2003 Barbier
6,668,484 B2 12/2003 Riccobene
D486,246 S 2/2004 Manthei
D488,566 S 4/2004 Fleishman
6,715,956 B1 4/2004 Weber et al.
D492,796 S 7/2004 Price
6,881,463 B2 4/2005 Riccobene
D505,733 S 5/2005 Castonguay et al.
D506,013 S 6/2005 Anderson et al.
D522,667 S 6/2006 Castonguay et al.
D536,058 S 1/2007 Riccobene
D537,501 S 2/2007 Riccobene
D537,959 S 3/2007 Castonguay et al.
D540,954 S 4/2007 Bouchard
D541,436 S 4/2007 Wissman
D543,642 S 5/2007 Castonguay et al.
D550,375 S 9/2007 Thomassen et al.
D553,260 S 10/2007 Castonguay et al.
D553,759 S 10/2007 Hamel
7,393,155 B2 7/2008 Riccobene
7,425,106 B2 9/2008 Altmann et al.
D578,658 S 10/2008 Keys
D586,925 S 2/2009 Riccobene
D590,070 S 4/2009 Castonguay et al.
D590,071 S 4/2009 Castonguay et al.
D590,072 S 4/2009 Castonguay et al.
D602,173 S 10/2009 Thomassen
D602,604 S 10/2009 Harris
D606,210 S 12/2009 Thomassen
7,637,688 B2 12/2009 Riccobene
7,674,067 B2 3/2010 Riccobene
D618,364 S 6/2010 Schrom et al.
D620,616 S 7/2010 Ciccarello
D624,202 S 9/2010 Thomassen et al.
D624,203 S 9/2010 Thomassen et al.
7,811,027 B2 * 10/2010 Scheiwiller ..... E01C 5/00 404/38
7,850,393 B2 12/2010 Hamel
D640,800 S 6/2011 Thomassen
D643,544 S 8/2011 Thomassen
7,988,382 B2 8/2011 Castonguay
7,993,718 B2 8/2011 Riccobene
D645,573 S 9/2011 Dallaire et al.
D645,574 S 9/2011 Thomassen
8,011,152 B2 9/2011 Thomassen

(56) References Cited

U.S. PATENT DOCUMENTS

| | | | | |
|---|---|---|---|---|
| D646,600 | S | 10/2011 | Minkkinen | |
| 8,132,981 | B2 | 3/2012 | Castonguay et al. | |
| D660,982 | S | 5/2012 | Thomassen | |
| D664,677 | S | 7/2012 | Riccobene | |
| 8,226,323 | B2 | 7/2012 | Bouchard et al. | |
| 8,282,311 | B2 | 10/2012 | Chow | |
| 8,298,641 | B2 | 10/2012 | Riccobene | |
| 8,337,116 | B2 | 12/2012 | Castonguay et al. | |
| 8,413,397 | B2 | 4/2013 | Lacas et al. | |
| 8,500,361 | B2 | 8/2013 | Castonguay et al. | |
| D695,915 | S | 12/2013 | Dignard et al. | |
| D695,916 | S | 12/2013 | Dignard et al. | |
| D695,917 | S | 12/2013 | Dignard et al. | |
| D695,918 | S | 12/2013 | Dignard et al. | |
| D695,919 | S | 12/2013 | Dignard et al. | |
| D695,920 | S | 12/2013 | Dignard | |
| D695,921 | S | 12/2013 | Dignard | |
| D695,922 | S | 12/2013 | Dignard | |
| 8,609,215 | B2 | 12/2013 | Riccobene | |
| 8,616,803 | B2 * | 12/2013 | Gebhart | E01C 5/06 404/37 |
| 8,667,752 | B2 * | 3/2014 | Pollack | E01C 5/00 404/34 |
| 8,668,404 | B2 | 3/2014 | Bouchard et al. | |
| 8,747,019 | B2 | 6/2014 | Castonguay et al. | |
| 8,769,896 | B2 | 7/2014 | Lacas et al. | |
| 8,967,907 | B2 | 3/2015 | Castonguay et al. | |
| 9,057,197 | B2 | 6/2015 | Lacas et al. | |
| 9,193,215 | B2 | 11/2015 | Castonguay et al. | |
| 9,315,950 | B2 | 4/2016 | Browning et al. | |
| 2003/0007834 | A1 | 1/2003 | Bolduc et al. | |
| 2004/0163353 | A1 | 8/2004 | Dean | |
| 2007/0077387 | A1 | 4/2007 | Riccobene | |
| 2007/0217865 | A1 | 9/2007 | Castonguay et al. | |
| 2008/0095577 | A1 | 4/2008 | Brun | |
| 2008/0101860 | A1 * | 5/2008 | Scheiwiller | E01C 5/00 404/42 |
| 2008/0209828 | A1 | 9/2008 | Riccobene | |
| 2008/0240857 | A1 | 10/2008 | Ciccarello | |
| 2009/0097916 | A1 * | 4/2009 | Schroder | E01C 5/00 404/41 |
| 2010/0162648 | A1 | 7/2010 | Thomassen | |
| 2010/0236174 | A1 | 9/2010 | Castonguay et al. | |
| 2010/0307092 | A1 | 12/2010 | Bouchard et al. | |
| 2011/0067333 | A1 | 3/2011 | Lacas et al. | |
| 2011/0293873 | A1 | 12/2011 | Riccobene | |
| 2012/0003040 | A1 | 1/2012 | Castonguay et al. | |
| 2012/0057933 | A1 * | 3/2012 | Gebhart | E01C 5/06 404/41 |
| 2012/0189386 | A1 | 7/2012 | Castonguay et al. | |
| 2012/0247050 | A1 | 10/2012 | Bouchard et al. | |
| 2013/0017016 | A1 | 1/2013 | Castonguay et al. | |
| 2013/0259569 | A1 | 10/2013 | Castonguay et al. | |
| 2013/0263543 | A1 | 10/2013 | Lacas et al. | |
| 2013/0302088 | A1 * | 11/2013 | Penshorn | E01C 5/06 404/41 |
| 2014/0047788 | A1 | 2/2014 | Riccobene | |
| 2014/0112715 | A1 | 4/2014 | Browning et al. | |
| 2014/0169878 | A1 * | 6/2014 | MacDonald | E01C 5/003 404/41 |
| 2014/0205807 | A1 | 7/2014 | Lacas et al. | |
| 2014/0241799 | A1 | 8/2014 | Castonguay et al. | |
| 2014/0260059 | A1 | 9/2014 | Riccobene | |
| 2015/0104588 | A1 | 4/2015 | Castonguay et al. | |
| 2015/0176224 | A1 | 6/2015 | Dignard et al. | |
| 2016/0076256 | A1 | 3/2016 | Castonguay et al. | |

FOREIGN PATENT DOCUMENTS

| | | |
|---|---|---|
| CA | 2083215 | 5/1994 |
| CA | 2519296 | 10/2004 |
| CA | 2569998 | 5/2006 |
| CA | 2616200 | 4/2008 |
| CH | 562921 | 6/1975 |
| DE | 7122262 | 11/1971 |
| DE | 3533020 | 3/1987 |
| DE | 9211118 | 3/1993 |
| DE | 4232300 | 3/1994 |
| DE | 4333942 | 4/1995 |
| DE | 19747421 | 4/1999 |
| DE | 19937639 | 2/2000 |
| DE | 29922003 | 2/2000 |
| DE | 10001967 | 7/2001 |
| DE | 20101214 | 5/2002 |
| EP | 0424592 | 5/1991 |
| EP | 0666372 A1 | 8/1995 |
| FR | 2354416 | 1/1978 |
| GB | 1094632 | 12/1967 |
| GB | Des. 1047163 | 12/1987 |
| GB | 2208883 | 4/1989 |
| GB | 2214206 | 8/1989 |
| JP | 2002/285504 | 10/2002 |
| JP | 1180760 | 6/2003 |
| JP | 1180761 | 6/2003 |
| JP | 1180860 | 6/2003 |
| JP | 1180861 | 6/2003 |
| JP | 2004-124634 | 4/2004 |
| JP | 3640654 | 1/2005 |
| NL | 7415523 | 6/1976 |
| SE | Des. 44357 | 10/1988 |
| WO | 94/15025 | 7/1994 |
| WO | 0144578 | 6/2001 |
| WO | 01/53612 | 7/2001 |
| WO | 02059423 | 8/2002 |
| WO | 02/089934 | 11/2002 |
| WO | 2005084900 | 9/2005 |
| WO | 2006045192 | 5/2006 |
| WO | 02095133 | 11/2008 |
| WO | 2009039617 | 4/2009 |
| WO | 2009140760 | 11/2009 |

OTHER PUBLICATIONS

Fitzgerrell, Basic Masonry Illustrated, a Sunset Book, 1981, pp. 76-77, Lane Publishing Co., Menlo Park, CA, U.S.A.

Bomanite Corp., "Leadership: A Reputation for Excellence, Innovation & Experience", 5 sheets of literature, available at least as early as Oct. 24, 2004.

Brickform Patterns—1 Sheet, 1994.

Brickform Texture Mats—2 Sheets, 1988.

Brickform Tools—Texture Mats—4 Sheets, available at least as early as Oct. 24, 2004, 4 sheets.

Color Tile Advertisement, Royal Rock Ceramic Tile, Jan. 14, 1990, Houston Post, Houston, TX, U.S.A.

Creative Impressions, Ltd., Export Price List and Drawings, Apr. 1990, U.K.

Exhibit G—Photocopy of Front of Color Tile Royal Rock Ceramic Tile, available at least as early as Oct. 24, 2004.

Exhibit H—Photocopy of Rear of Color Tile Royal Rock Ceramic Tile, available at least as early as Oct. 24, 2004.

Decristoforo, Handyman's Guide to Concrete and Masonry, 1978, pp. 183-189, Reston Publishing Co., Inc., Reston, VA, U.S.A.

Decristoforo, Handyman's Guide to Concrete and Masonry Handbook, 1960, p. 70, Arco Publishing Co., Inc., New York City, NY, U.S.A.

Lasting Impressions in Concrete, Inc., available at least as early as Oct. 24, 2004, 6 sheets of literature.

Patterned Concrete Industries, Inc., Specifications, available at least as early as Oct. 24, 2004, 3 sheets.

Sweet's Catalog, vol. 2 Bomacron Patterns, 1994.

Sweets General Building and Renovation, 1993 Catalog File, p. 11, Anchor Buyline 6518, 04200/ANC.

Duncan, The Complete Book of Outdoor Masonry, 1977, pp. 342-345, TAB Books, Blue Ridge Summit, PA, U.S.A.

Uni-Group U.S.A.—Manufacture of Uni Paving Stones the Original. The Best., 1992, Palm Beach Gardens, FL, U.S.A.

Gmnbaum, B. and Shephard, G.C., "Tilings and Patterns," 1987, pp. 288-290, 510 W.H. Freeman and Company, New York, N.Y.

(56) References Cited

OTHER PUBLICATIONS

"Landscapes Become Dreamscapes," Pavestone Company, 2003, 2 pages.
Neolithics Masonry Design, www.neolithicsusa.com, Nov. 2003, 3 pages.
Author: Jinny Beyer, Designing Tessellatins: The Secrets of Interlocking Patterns, Chapter 7: The Keys to creating Interlocking Tessellations: pp. 1-7, 16-17 and 125-165, 1999.
Nature Walk™ Natural Flagstone Appeal for Pedestrian Traffic, 2001, 4 pages.
Website: www.sf-kooperation.de/english/index—Pentalith, Canteon, Jul. 2001, 3 pages.
Website:www.sf-kooperation.de/english/index—Canteon®; CIS 300-10; Pentalith, Sep. 2003, 5 pages.
Retaining Walls, Pavestone Brochure, published 2002, 6 pages.
Concrete Landscaping/Products, Oldcastle Brochure, published 2002, 12 pages.
Website: www.mathforum.org/sum95/suzanne/whattess.html—What is Tessellation?—dated Apr. 24, 2002, 4 pages.
Beautiful Edgers, Pavestone Brochure, published 2002, 5 pages.
Website: www.superstone.com—Split Rock, Dec. 2002, 1 page.
Website: www.matcrete.net/RandomStone.htm—Matcrete The Ultimate in Concrete Design, Dec. 2002, 1 page.
Patio Dreamscapes, Pavestone Brochure; Sandstone System, published 2003, 5 pages.
Landscaping Stones, Mat Stone Brochure, Nature Walk, Garden Walk, published 2003, 2 pages.
Paving Stone Dreamscapes, Pavestone Brochure, published 2003, 13 pages.
Website: www.geckostone.com—Geckostone™,Mar. 2003, 4 pages.
Website: www.learningcompanyschool.com—TesselMania! Deluxe, Jun. 2003, 3 pages.
Website: riverdeep.net/products/other/tesselmania.jhtml—TesselMania!, Jun. 2003, 4 pages.

* cited by examiner

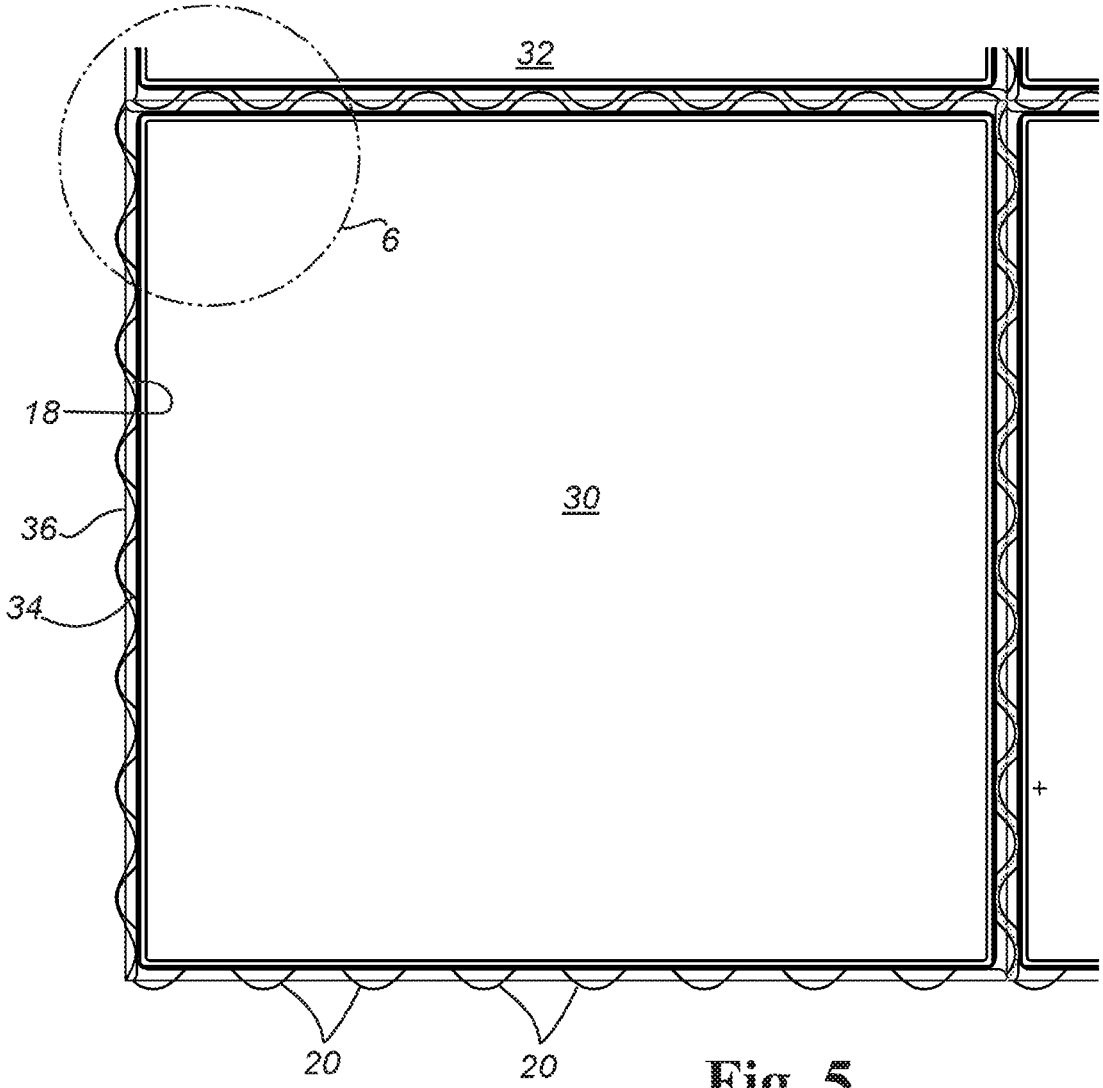
Fig. 5
Fig. 6
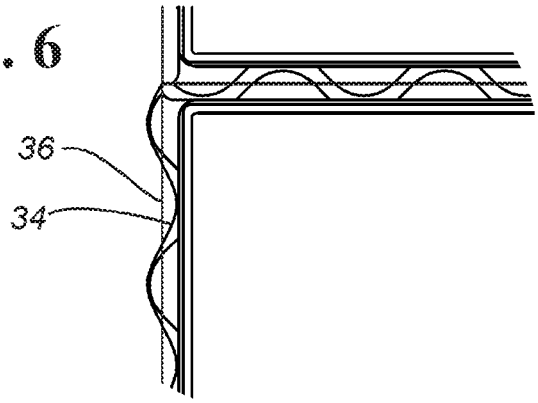

PAVING STONES

CROSS REFERENCE TO RELATED APPLICATIONS

This application is a continuation of U.S. patent application Ser. No. 14/056,220 filed Oct. 17, 2013, allowed, which claims priority to U.S. Provisional Patent Application Ser. No. 61/716,033 for "Paving Stones" filed Oct. 19, 2012, Len Browning and Robert J. Lundell, inventors, the contents of all of which are incorporated herein by reference in their entireties.

FIELD OF THE INVENTION

This invention relates to paving stones and blocks, natural and manmade.

BACKGROUND

Paving stones have been in use for thousands of years. Initially such stones were literally that, naturally occurring stones or rocks of various shapes and compositions. Even the earliest installers of such stones recognized that stones of regular shapes and sizes facilitated their installation and effectiveness in use. That doubtless led initially to care in selecting stones and placing them and later to preparatory shaping of stones to facilitate their installation and function. Eventually such regular shapes came to be embodied in man-made bricks and "stones," including a variety of different shapes and compositions.

Notwithstanding thousands of years of human experience in paving a variety of different surfaces for a variety of different reasons and uses, the need continues for pavers that can better address certain requirements.

Among those requirements are the need to successfully transfer the load of vehicles that use the paving to the subgrade without damaging the base course or its stability.

As is explained by the ICPI Tech SPEC Number 1 (Glossary of Terms for Segmental Concrete Pavement), interlocking concrete pavement is a system of paving that consists of discrete, hand-sized paving units with either rectangular or dentated shapes manufactured from concrete. The units are placed in an interlocking pattern, compacted into coarse bedding sand, the joints filled with sand and compacted again to start interlock.

Interlocking results when frictional forces between paving units prevent them from rotating, or moving horizontally or vertically in relation to each other. Interlocking is also defined as the inability of a concrete paver to move independently of its neighbors. Friction forces enable load transfer among the paving units. There are three kinds of load transfer, vertical interlock, horizontal interlock and rotational interlock. Vertical interlock is achieved by shear transfer of loads to surrounding units through sand in the joints. Horizontal interlock is primarily achieved through the use of laying patterns that disperse forced from braking and accelerating vehicles. Rotational interlock is achieved by using pavers of sufficient thickness, placed closely together, and restraining them by a stationary edge such as a curb.

Interlocking is not, however, the only characteristic of concern. Many paver installations need to accommodate the flow of water through the paved surface and into underlying structures, installations of which pavers are sometimes referred to as permeable interlocking concrete pavement.

Likewise, it is important the pavers be attractive, easy to install manually or with mechanical systems, and that they be easy to manufacture economically, quickly and reliably without undue complexity in the manufacturing equipment and without undue difficulty associated with wear of the manufacturing equipment.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

The pavers of this invention are attractive, easy and inexpensive to manufacture and install and can be assembled into strong paver systems that achieve good vertical, horizontal and rotational interlocking, balanced with substantial permeability to allow water to drain through such systems into underlying structures.

Pavers of this invention may be made in a number of different shapes, usually generally (a) square, (b) rectangular, (c) triangular, or (d) that can be thought of as combinations of squares, rectangles and triangles (such as L-shaped and parallelogram-shaped stones). The pavers of this invention may also be made in other shapes such as hexagons.

Significantly, the vertical walls of these pavers include "serpentine," "sinuous," "wavy," "saw tooth," "sinusoidal" or "crenelated" portions (when viewed in plan or "from above") that are positioned to inter-fit with like-shaped portions of other pavers of this system in assemblies of pavers. (The term "serpentine" will generally be used in this patent to mean all of the above and other appropriate terms for wall portions of the general shapes described and depicted herein).

These serpentine wall portions contact abutting paver wall portions to maintain desired separation between pavers to permit vertical water flow when desired. Moreover, the serpentine wall portions providing superior frictional vertical interlocking, as well very effective horizontal and rotational interlocking between pavers. These serpentine wall portions are easier to produce and more durable than more angular side wall shapes. Superior frictional interlocking enables pavers of particular geometries and dimensions to accommodate more water flow because there is relatively more room for vertical water flow channels.

While serpentine wall portions can be used with numerous other paver shapes such as hexagons, among others, they are well-adapted for use with pavers that are rectangles, including squares, or combinations of rectangles, such as L-shaped pavers, triangles, parallelograms and combinations of triangles and rectangles.

BRIEF DESCRIPTION OF THE DRAWINGS

Illustrative embodiments of the present invention are described in detail below with reference to the following drawing figures:

FIG. 5 is a model of a paving stone edge shape illustrating the length of contacting faces with an exemplary serpentine block edge shape.

FIG. 6 is an enlarged fragment of FIG. 5 taken at circle "6."

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Figure 1:
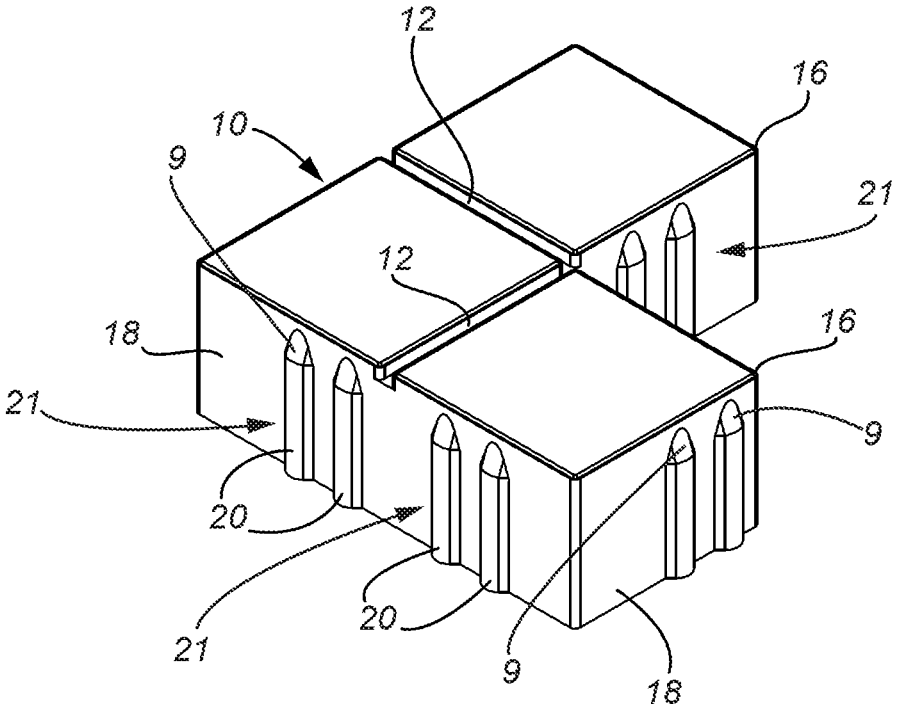
FIG. 1 is an isometric view of a generally L-shaped embodiment of a paving stone of the this invention.
Figure 2:
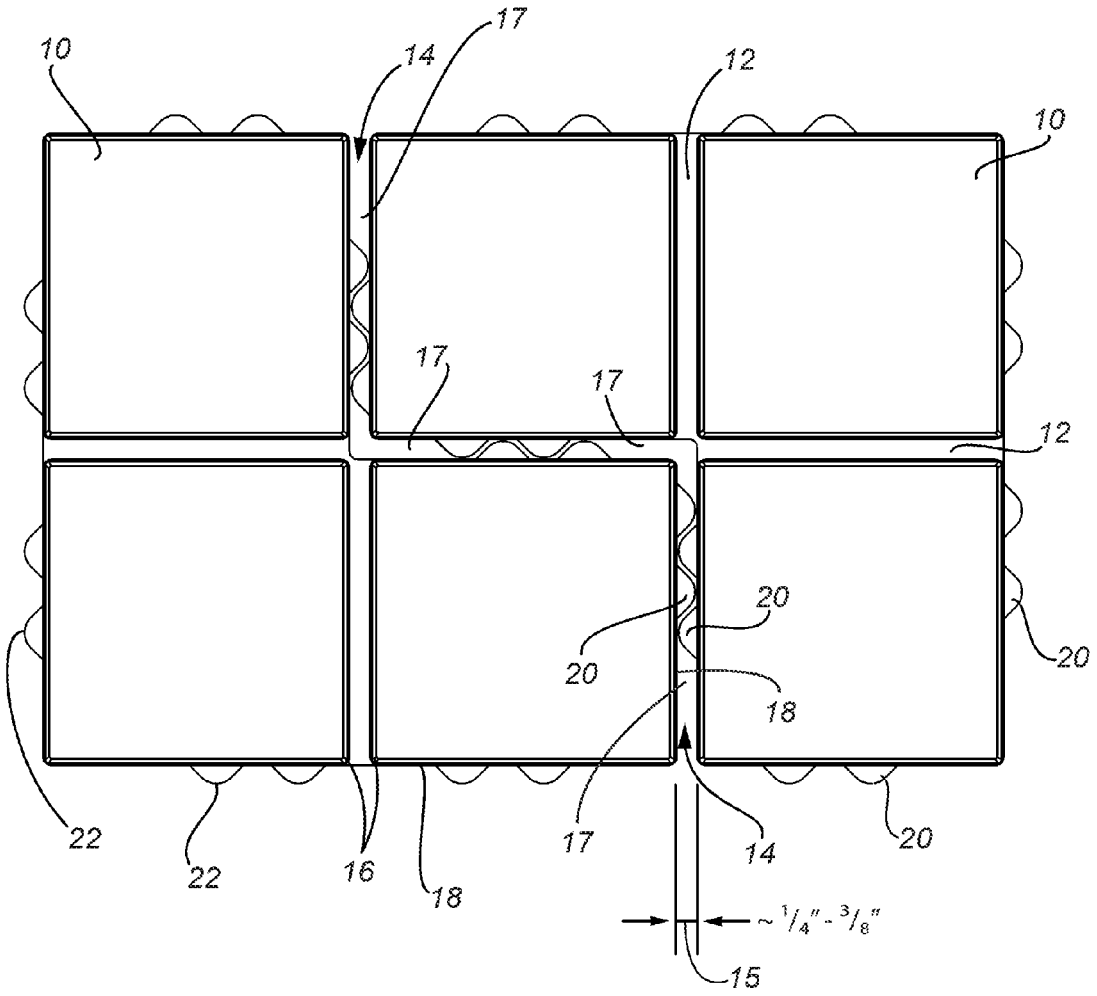
FIG. 2 is a top plan view of two abutting L-shaped stones like the one shown in FIG. 1.
Figure 3:
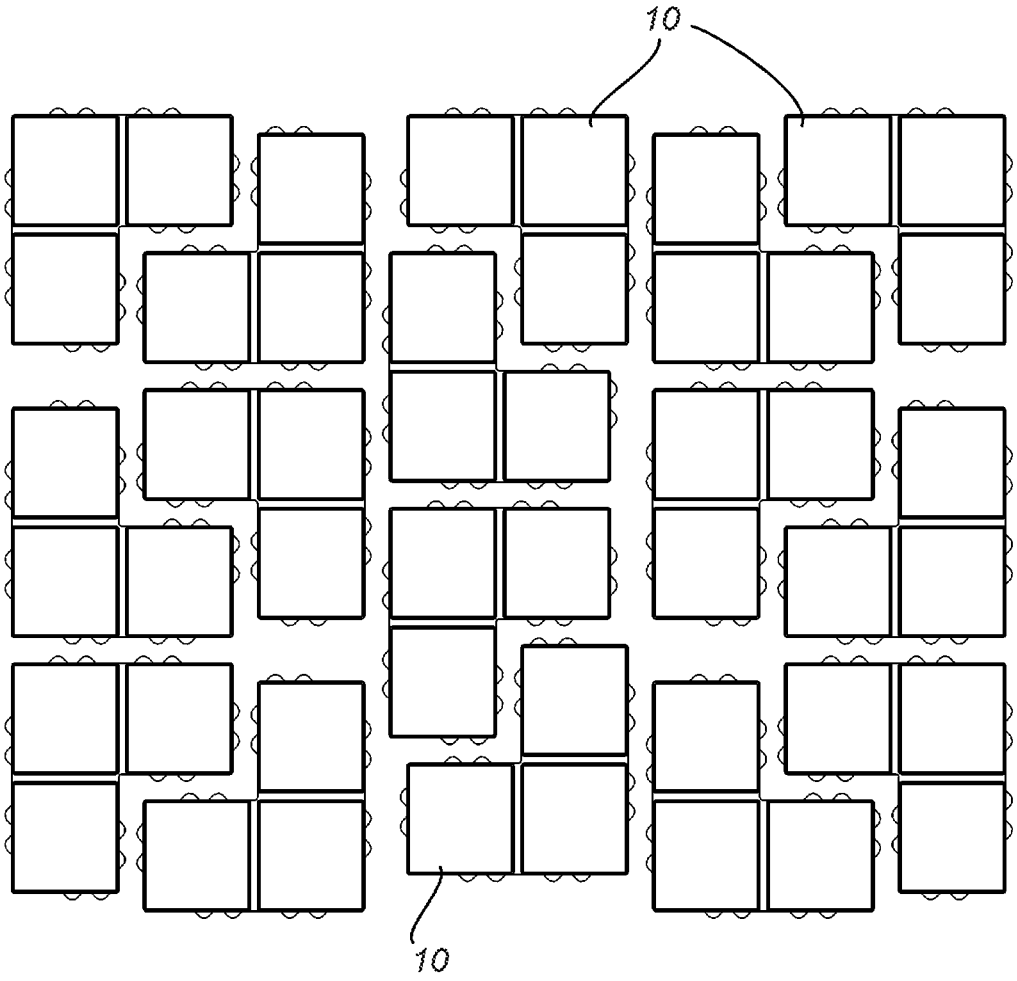
FIG. 3 is a top plan view of one embodiment of a mold pallet layout of L-shaped stones like those shown in FIG. 1.

FIGS. 1 and 2 depict an L-shaped paving stone 10 having false joints 12 that look like the full joints 14 visible in FIG. 2 to create an installed pattern appearing to be made of square pavers 16. Each stone 10 has side walls 18 and spacers 20 with curved cross-section crowns 22. Spacers 20 serve at least two purposes. First, they separate stones 10 in a pavement installation so that (a) there are vertical channels 17 between stones 10 that can "filled" with clean, open graded fine aggregate and through which water can flow and (b) stones 10 will be uniformly spaced and aligned in paving installations. Second, the spacers provide interlocking contact surfaces 21 between tiles that interlock the stones 10 vertically, horizontally and rotationally.

As may be appreciated by reference to FIG. 2, arrangements of L-shaped stones 10 with the square paver units 16 oriented in rows and columns will result in inter-fitting of spacers 20 with the crown or furthest protruding portion 22 of spacers 20 on one stone 10 in contact with the side walls 18 of an adjacent stone 10.

Figure 8:
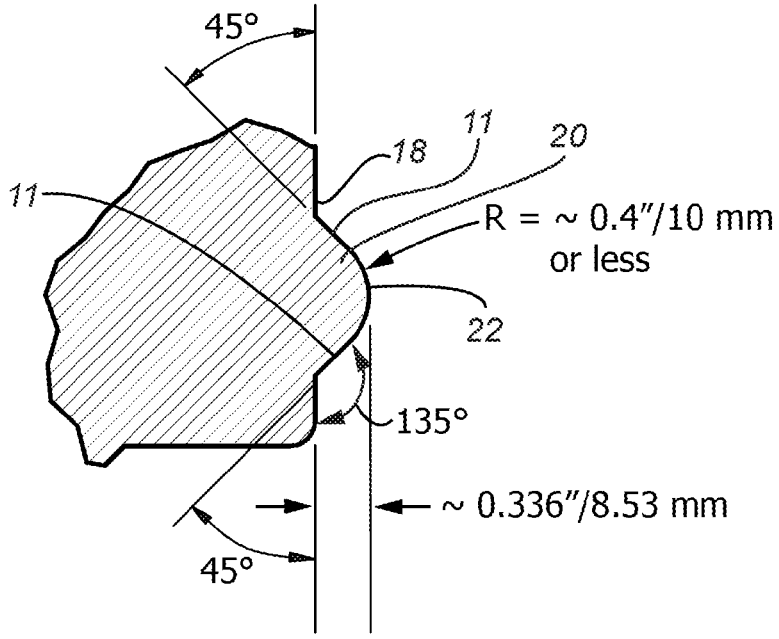
FIG. 8 is an enlarged fragment of FIG. 7 taken at circle "8."

FIG. 8 provides an enlarged fragment showing an exemplary spacer 20 geometry and dimensions, but other geometries and dimensions are also possible. The tops 9 of spacers 20 can be square to the spacer 20 and paver walls 18, but a sloping transition as depicted in the drawings typically is easier to manufacture and more durable in transportation, placement and use. In embodiments of this invention depicted in the drawings, (apart from the spacer top or transition 9) each spacer has two planer surfaces joined to each other by a curved or crown surface 22. Utilizing the geometry and dimensions depicted in the figures for spacers 20 (with spacers 20 projecting or protruding from walls 18 about one-third inch (specifically, for instance, projecting 0.336 inches (8.53 mm)) will provide spacing (15 on FIG. 2) of approximately ¼ to ⅜ inch between opposed walls 18 in assemblies of L-shaped blocks 10.

Use of spacer 20 walls 11 at an inside angle relative to the plane of wall 18 of approximately 45 degrees and, therefore, at an outside angle relative to the plane of wall 18 of approximately 135 degrees (so that the two spacer walls 11 of each spacer 20 are separated by approximately 90 degrees from each other) is beneficial and therefore desirable. For instance, use of the curved crown 22 and the planar wall angles described here makes the spacers easy to form and durable in manufacture, shipment, placement and use. However, other angles could also be used, and other shorter or longer radii than the radius of approximately 0.4 inches or less (about 10 mm or less) shown in FIG. 8 could be used.

Figure 7:
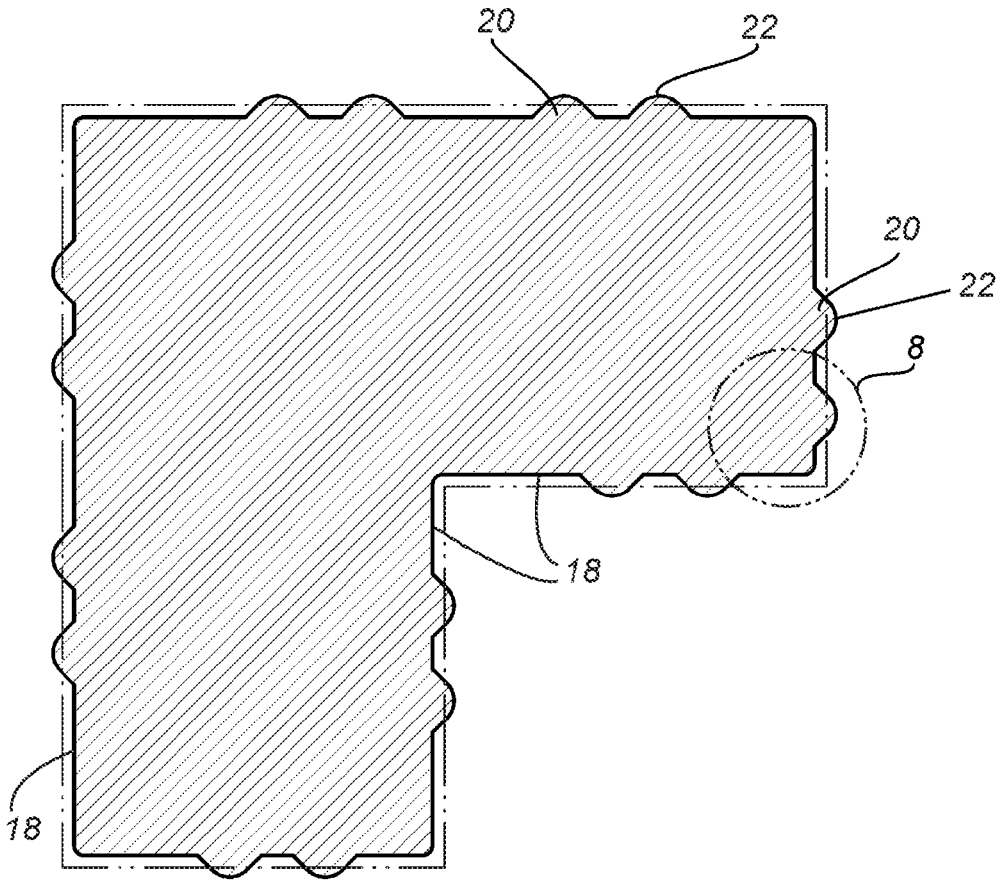
FIG. 7 is a horizontal cross section of the stone of FIG. 1.

As may be appreciated by reference to FIG. 7, the locations of spacers 20 on opposite walls of L-shaped pavers 10 are offset from each other by one-half of the distance between adjacent spacers 20 on each paver 10. This facilitates the inner-fitting of spacers 20 on abutting pavers 10 (illustrated in FIGS. 2, 4 and 9). The illustrated arrangement of pairs of spacers 18 result in automatic inter-fitting of spacers in substantially all practical arrangements of L-shaped blocks 10.

Figure 4:
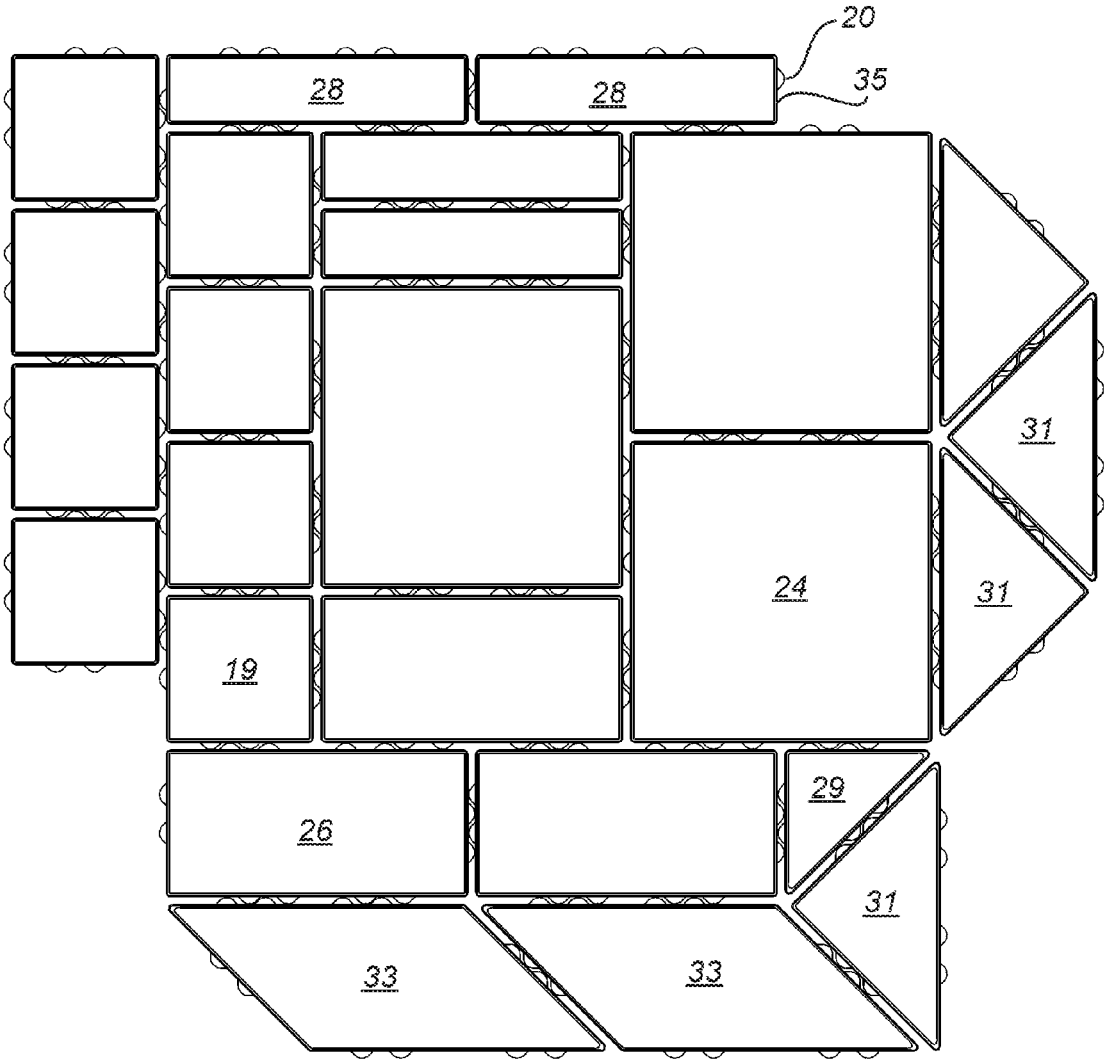
FIG. 4 is a top plan view of an arrangement of several different paving stone embodiments of this invention.
Figure 11:
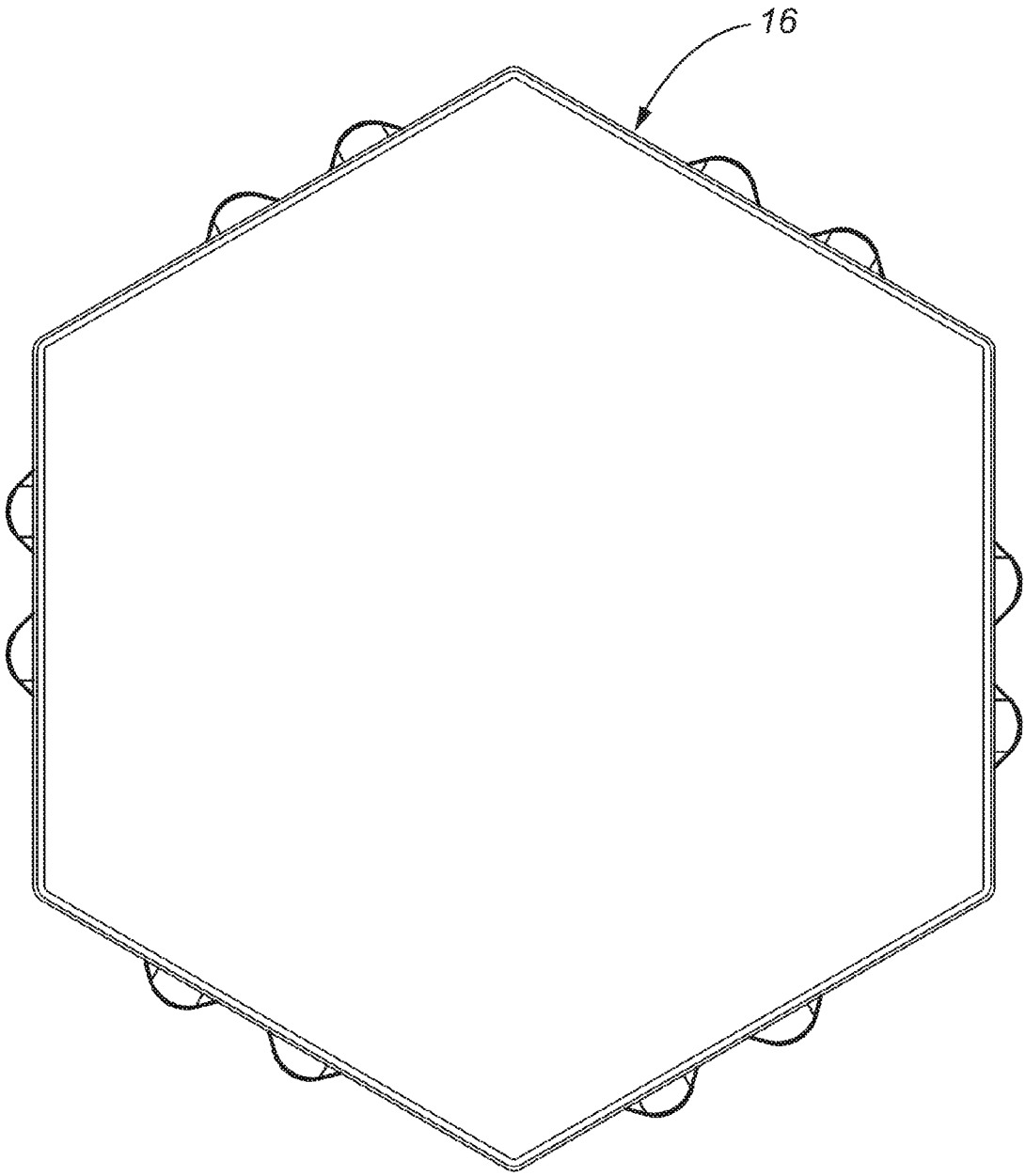
FIG. 11 depicts a top plan view of hexagonal paving stone of this invention.
Figure 12:
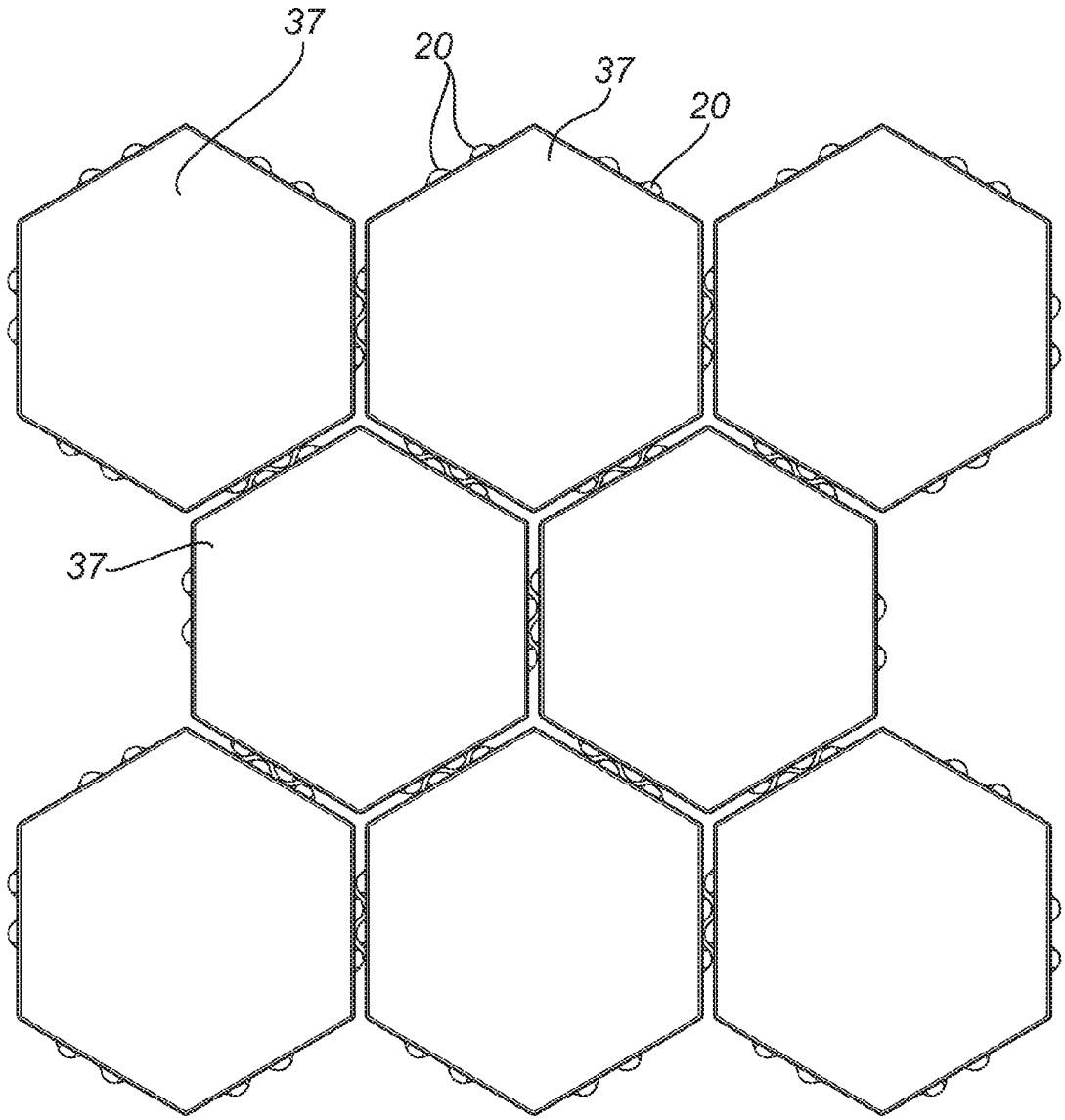
FIG. 12 is a top plan view of an assembly of hexagonal stone like the stone of FIG. 11.

Alternative sizes and shapes of pavers are shown in FIG. 4, which includes small square pavers 22, large square pavers 24, large rectangular pavers 26, small rectangular pavers 28, small triangular pavers 29, large triangular pavers 31 and parallelogram pavers 33. Hexagonal pavers 37 are shown in FIGS. 11 and 12. As is depicted in FIGS. 4 and 12, the narrow rectangular pavers 28 have room for only one spacer 20 one each paver 28 end 35 using spacers 20 of the size and locations depicted in the drawings. As is clear from the Figures, particularly including FIG. 4, this invention may be embodied in pavers having a number of different general shapes. For simplicity only, however, much of the description herein focuses on and describes an exemplary L-shaped paver 10. The embodiments of the present invention and the following patent claims should not be understood to be limited to L-shaped pavers or any other particular paver shape unless a description or claim explicitly contains such a limitation.

As mentioned above, vertical interlocking between paving stones is achieved by shear transfer of loads to surrounding units. This occurs as a result of contact between the sides of pavers and through coarse sand or other aggregated in the joints between the opposed sides of closely spaced pavers. Some horizontal interlocking occurs for the same reason, but the laying pattern of pavers and interlocking between pavers also contribute to horizontal interlocking.

The "serpentine," "sinuous," "wavy," "saw tooth," "sinusoidal" or "crenelated" portions of the side walls of the pavers of this invention provide enhanced vertical interlocking because they increase and optimize the surface areas of abutting pavers that are in contact with each other (directly or through coarse sand or other aggregate in the joints). Simply stated, more surface contact (for a given side wall portion), better resists relative vertical movement between adjacent stones, and this results is greater vertical interlocking. The surface interface between abutting pavers 10 of this invention is not a plane (as would be the case with flat walls) but is an undulating or wavy surface.

Horizontal interlocking occurs as a result of similar contact between the sides of pavers and through coarse sand or other aggregate in the joints between the opposed sides of closely spaced pavers. Significantly, horizontal interlocking also occurs in the interlocking structure of the side walls 18. Force applied horizontally tending to cause relative horizontal movement between abutting stones is resisted by friction and by the protruding ridges 20 that transfer force from the ridges 20 on one paver 10 to the ridges 20 on an abutting paver 10.

Figure 9:
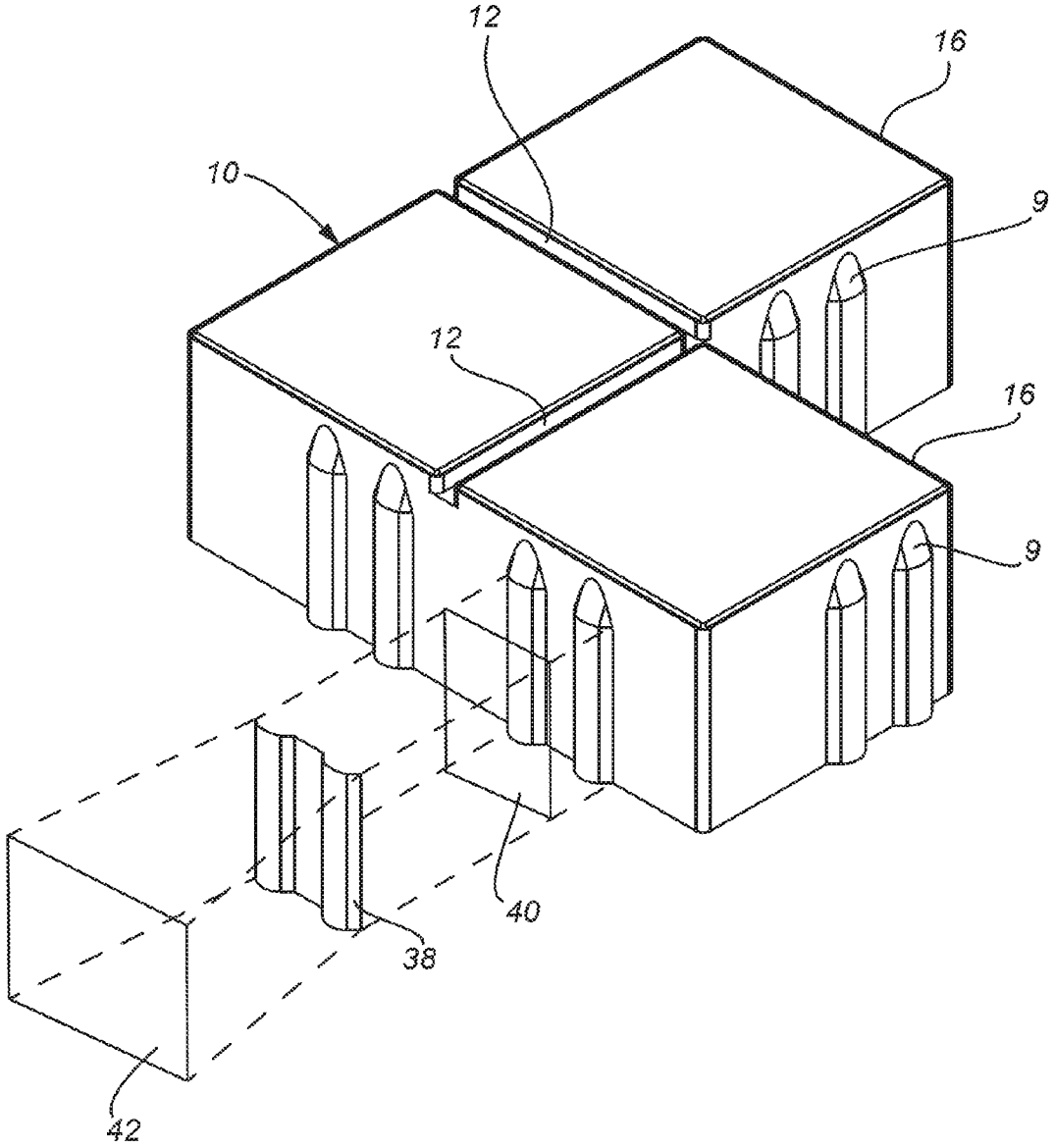
FIG. 9 is a view similar to FIG. 1 with a "sinuous" or "serpentine" portion of the paver wall projected and flattened to show its greater effective contact area.

FIGS. 5 and 6 facilitate description of these reasons that enhanced interlocking may be achieved in embodiments of this invention. FIG. 5 depicts a hypothetical square paver 30 that has spacers 20 that are shown (on the top and right sides) inter-fitted with other spacers 20 on a second square paver 32. The "contact path" 34 (that is, an "edge view" of a contact surface between pavers) is illustrated, together with a hypothetical "straight line" contact path 36. As can be easily seen by comparison of these lines 34 and 36, the serpentine path is longer. For a 12 inch square paver 30 with the spacer 20 shape and geometry illustrated in the figures and described above, the serpentine path has been calculated to be 8.62% longer than the straight line path 36, which means an 8.62% larger contact surface. Such a larger, sinusoidal, wavy or undulating contact surface 38 is depicted in FIG. 9 as if separated from the stone 10 and is compared to a flat surface 40 occupying the same portion of the stone 10 wall 18 as the undulating surface 38. If undulating surface 38 is "flattened," it is the same height but is wider and therefore a larger surface 42. Thus the vertically-extending straight, horizontally-extending serpentine contact surface contact surface 38 provides a greater contact area for a given width of paver 10 wall 18. This reduction in the portion of the side that needs to be used in interlocking permits a larger area where the facing walls 18 are separated. At the same time it provides enhanced interlocking, a vertically-extending straight, horizontally-extending serpentine surface shape permits and facilitates formation of the pavers 10 using conventional paver-making equipment and likewise facilitates relative vertical movement of pavers 10 in placement or removal of the pavers.

As a consequence of the capacity for achieving acceptably significant interlocking utilizing the serpentine shapes described above, greater portions of a particular side wall 18 can be straight and separated from the opposing side wall 18 of an adjacent block, thereby providing greater areas 17 (see FIG. 2) and greater capacity for flow of water down between the opposed side walls 18 and into underlining structure in a paving system designed to permit water infiltration.

Figure 10:
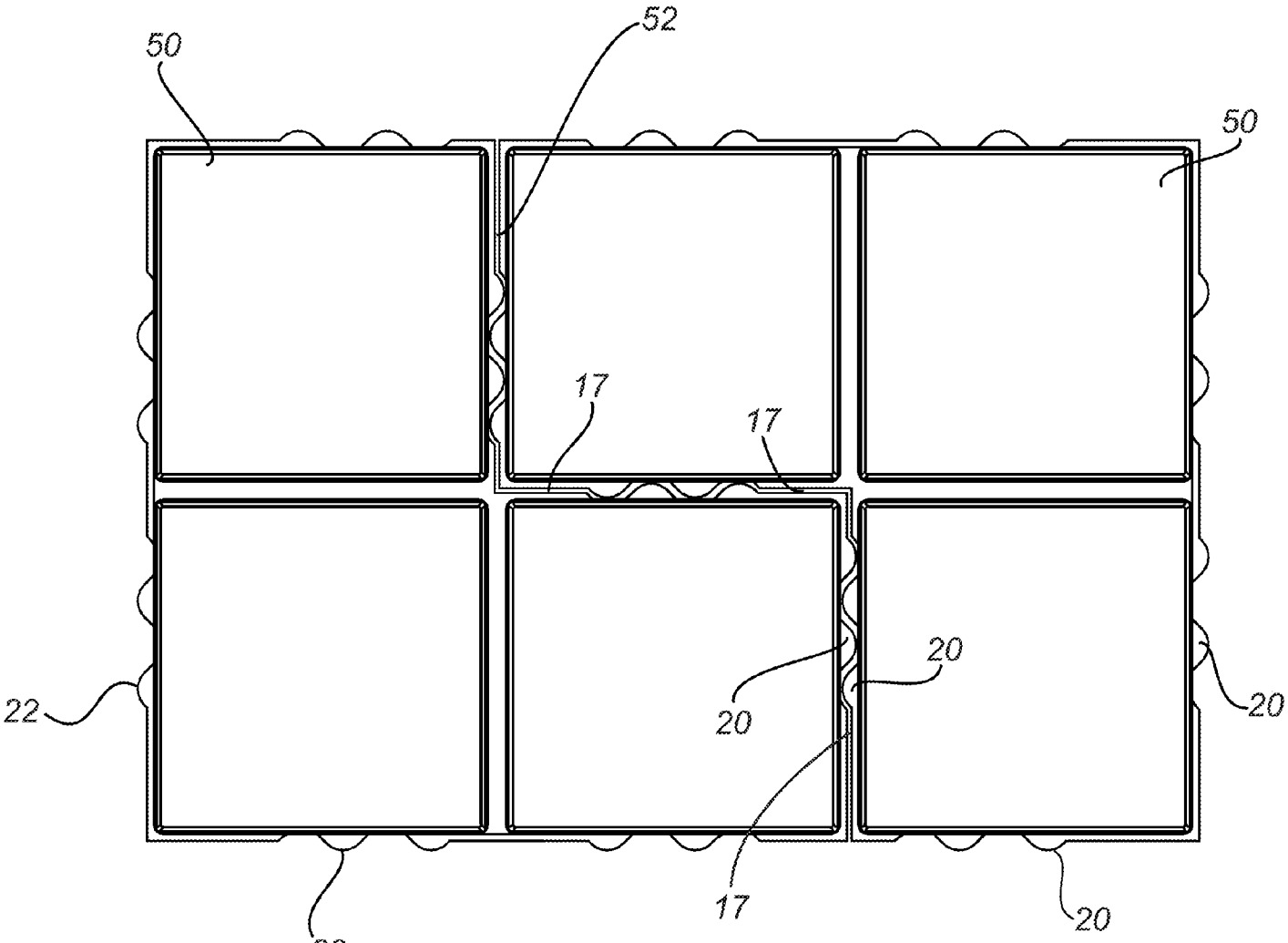
FIG. 10 depicts an alternative embodiment of the pavers of this invention with abutting walls for substantially water impermeable paving installations.

If embodiments of the pavers 10, 19, 24, 26, 28, 29, 31, 33 and 37 of this invention are to be used in installations where water infiltration is not needed, as is illustrated in FIG. 10, opposed portions of the walls 17 of pavers 50 can abut at 52 (with space for coarse concrete sand), thereby enhancing frictional interlocking of the pavers because of the greater wall contact. Additional spacers 20 could also be used to further enhance interlocking since areas with wide gaps for water infiltration are not needed.

The design of the spacer 20 of this invention permits the produced products to grow slightly in size as a result of wear of the manufacturing molds and, in effect, adjust to the enlarged units without creating interferences because the interfacing block shapes are forgiving and can be simply scaled up or down without changing block to block relationships.

In addition to increased frictional area between abutting pavers as a result of the serpentine frictional area, the projecting spacers resist relative motion of pavers horizontally because the projecting spacers 20 act as "stops" resisting such relative movement.

Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

That which is claimed is:

1. A dry cast paver for use in combination with other like dry cast pavers, the paver comprising:

(a) top and bottom horizontal surfaces;

(b) four vertical walls, the four vertical walls including a first pair of opposite parallel vertical walls and a second pair of opposite parallel vertical walls;

(c) a plurality of identical spacers projecting from each of the vertical walls;

(i) each of the vertical walls having at least 3 aligned straight sections with one spacer in between each adjacent pair of straight sections;

(ii) each vertical wall having at least one spacer pair;

(A) each spacer pair having two spacers separated by one of the straight sections a first distance sized to receive a spacer from an adjacent like paver to interlock the pavers; the first distance being shorter in length than all other straight sections that are not between the spacers in a spacer pair;

(B) each spacer pair being offset from the spacer pair on the opposite parallel wall by half of the first distance; and (iii) each spacer having two angled, straight walls converging as they extend away from the straight sections and joined by a crown surface.

2. The paver of claim 1 wherein each crown surface is curved.

3. The paver of claim 1 wherein the paver is rectangular, with the first pair of vertical walls being greater in length than the second pair of vertical walls.

4. The paver of claim 3 wherein:

(a) the first pair of vertical walls has two spacer pairs; and (b) the second pair of vertical walls has no more than one spacer pair.

5. The paver of claim 1 wherein the paver is square-shaped, with the first pair of vertical walls and the second pair of vertical walls all having the same length.

6. The paver of claim 1 wherein each sloped surface intersecting with one of the vertical walls at an outside angle of about 135°.

7. The paver of claim 1 wherein each spacer extends about 0.336 inch from a respective vertical wall.

8. The paver of claim 1 wherein the top and bottom horizontal surfaces are parallel and planar.

9. The paver of claim 1 wherein the four vertical walls are perpendicular to the top and bottom surfaces.

10. The paver of claim 1 wherein a top of each of the spacers has a sloping transition from the paver top surface.

11. A dry cast paver for use in combination with other like dry cast pavers, the paver comprising:

(a) top and bottom horizontal surfaces;

(b) four vertical walls forming a rectangle, including a first pair of opposite parallel vertical walls and a second pair of opposite parallel vertical walls; the first pair of vertical walls being greater in length than the second pair of vertical walls;

(c) a plurality of identical spacers projecting from each of the vertical walls;

(i) each of the vertical walls in the first pair of vertical walls having two spacer pairs and 5 aligned straight sections with one spacer in between each adjacent pair of straight sections;

(ii) each of the vertical walls in the second pair of vertical walls having one spacer pair and 3 aligned straight sections with one spacer in between each adjacent pair of straight sections;

(iii) each spacer pair having two spacers separated by one of the straight sections a first distance sized to receive a spacer from an adjacent like paver to interlock the pavers; the first distance being shorter in length than all other straight sections that are not between the spacers in a spacer pair;

(iv) each spacer pair being offset from the spacer pair on an opposite wall by half of the first distance; and (v) each spacer having two angled, straight walls converging as they extend away from the straight sections and joined by a crown surface.

12. The paver of claim 11 wherein each crown surface is curved.

13. The paver of claim 11 wherein a top of each of the spacers has a sloping transition from the paver top surface.

14. The paver of claim 11 wherein the top and bottom horizontal surfaces are parallel and planar.

15. A dry cast paver for use in combination with other like dry cast pavers, the paver comprising:

(a) top and bottom horizontal surfaces;

(b) four vertical walls forming a square;

(c) a plurality of identical spacers projecting from each of the vertical walls;

(i) each of the vertical walls in the first pair of vertical walls having one spacer pairs and 3 aligned straight sections with one spacer in between each adjacent pair of straight sections;

(ii) each spacer pair having two spacers separated by one of the straight sections a first distance sized to receive a spacer from an adjacent like paver to interlock the pavers; the first distance being shorter in length than all other straight sections that are not between the spacers in a spacer pair;

(iii) each spacer pair being offset from the spacer pair on an opposite wall by half of the first distance; and (iv) each spacer having two angled, straight walls converging as they extend away from the straight sections and joined by a crown surface.

16. The paver of claim 15 wherein each crown surface is curved.

17. The paver of claim 15 wherein a top of each of the spacers has a sloping transition from the paver top surface.

18. The paver of claim 15 wherein the top and bottom horizontal surfaces are parallel and planar.

* * * * *